US007484566B2

(12) United States Patent
Tips et al.

(10) Patent No.: US 7,484,566 B2
(45) Date of Patent: Feb. 3, 2009

(54) PULSE WIDTH MODULATED DOWNHOLE FLOW CONTROL

(75) Inventors: Timothy R. Tips, Spring, TX (US); Mitchell C. Smithson, Pasadena, TX (US)

(73) Assignee: Welldynamics, Inc., Spring, TX (US)

( * ) Notice: Subject to any disclaimer, the term of this patent is extended or adjusted under 35 U.S.C. 154(b) by 131 days.

(21) Appl. No.: 11/462,077

(22) Filed: Aug. 3, 2006

(65) Prior Publication Data

US 2007/0034385 A1 Feb. 15, 2007

(30) Foreign Application Priority Data

Aug. 15, 2005 (US) ..... PCT/US2005/029007

(51) Int. Cl.
*E21B 28/00* (2006.01)
*E21B 34/10* (2006.01)

(52) U.S. Cl. ..... 166/373; 166/66.6; 166/177.6; 166/249; 166/320; 166/386

(58) Field of Classification Search ..... None
See application file for complete search history.

(56) References Cited

U.S. PATENT DOCUMENTS

| | | | |
|---|---|---|---|
| 1,885,820 | A | 11/1932 | Gothard et al. |
| 2,895,063 | A | 7/1959 | Morris |
| 2,960,109 | A | 11/1960 | Wilson |
| 3,342,267 | A | 9/1967 | Cotter et al. |
| 3,398,302 | A | 8/1968 | Harnau et al. |
| 3,663,845 | A | 5/1972 | Apstein |
| 3,766,399 | A | 10/1973 | Demetruscu |
| 3,772,541 | A | 11/1973 | Campagnuolo et al. |
| 3,968,387 | A | 7/1976 | Scarff |
| 3,970,877 | A | 7/1976 | Russell et al. |
| 4,015,234 | A | 3/1977 | Krebs |
| 4,047,832 | A | 9/1977 | Sforza |
| 4,215,426 | A | 7/1980 | Klatt |
| 4,362,106 | A | 12/1982 | Campagnuolo et al. |
| 4,387,318 | A | 6/1983 | Kolm et al. |
| 4,415,823 | A | 11/1983 | Jurgens |

(Continued)

FOREIGN PATENT DOCUMENTS

| | | |
|---|---|---|
| GB | 20044822 | 10/1980 |

(Continued)

OTHER PUBLICATIONS

Examination Report for UK application serial No. GB0419933.7.

(Continued)

*Primary Examiner*—Zakiya W. Bates
(74) *Attorney, Agent, or Firm*—Smith IP Services, P.C.

(57) ABSTRACT

A pulse width modulated downhole flow control. A downhole flow control system includes a flow control device with a flow restrictor which variably restricts flow through the flow control device. An actuator varies a vibratory motion of the restrictor to thereby variably control an average flow rate of fluid through the flow control device. A method of controlling flow in a well includes the steps of: installing a flow control device in the well, the flow control device including a flow restrictor which variably restricts flow through the flow control device; and displacing the restrictor to thereby pulse a flow rate of fluid through the flow control device.

33 Claims, 4 Drawing Sheets

U.S. PATENT DOCUMENTS

| | | | |
|---|---|---|---|
| 4,416,000 | A | 11/1983 | Scherbatskoy |
| 4,464,939 | A | 8/1984 | Corpron |
| 4,467,236 | A | 8/1984 | Kolm et al. |
| 4,491,738 | A | 1/1985 | Kamp |
| 4,536,674 | A | 8/1985 | Schmidt |
| 4,627,294 | A | 12/1986 | Lew |
| 4,769,569 | A | 9/1988 | Stahlhuth |
| 4,808,874 | A | 2/1989 | Stahlhuth |
| 4,825,421 | A | 4/1989 | Jeter |
| 5,101,907 | A | 4/1992 | Schultz et al. |
| 5,202,194 | A | 4/1993 | VanBerg, Jr. |
| 5,295,397 | A | 3/1994 | Hall et al. |
| 5,547,029 | A | 8/1996 | Rubbo et al. |
| 5,554,922 | A | 9/1996 | Kunkel |
| 5,626,200 | A | 5/1997 | Gilbert et al. |
| 5,703,474 | A | 12/1997 | Smalser |
| 5,801,475 | A | 9/1998 | Kimura |
| 5,839,508 | A | 11/1998 | Tubel et al. |
| 5,899,664 | A | 5/1999 | Lawrence |
| 5,907,211 | A | 5/1999 | Hall et al. |
| 5,965,964 | A | 10/1999 | Skinner et al. |
| 5,979,558 | A | 11/1999 | Bouldin et al. |
| 5,995,020 | A | 11/1999 | Owens et al. |
| 6,011,346 | A | 1/2000 | Buchanan et al. |
| 6,020,653 | A | 2/2000 | Woodbridge et al. |
| 6,112,817 | A | 9/2000 | Voll et al. |
| 6,179,052 | B1 | 1/2001 | Purkis et al. |
| 6,217,284 | B1 | 4/2001 | Lawrence |
| 6,351,999 | B1 | 3/2002 | Maul et al. |
| 6,371,210 | B1 | 4/2002 | Bode et al. |
| 6,424,079 | B1 | 7/2002 | Carroll |
| 6,470,970 | B1 | 10/2002 | Purkis et al. |
| 6,478,091 | B1 | 11/2002 | Gano |
| 6,504,258 | B2 | 1/2003 | Schultz et al. |
| 6,554,074 | B2 | 4/2003 | Longbottom |
| 6,567,013 | B1 | 5/2003 | Purkis et al. |
| 6,567,895 | B2 | 5/2003 | Scales |
| 6,575,237 | B2 | 6/2003 | Purkis et al. |
| 6,585,051 | B2 | 7/2003 | Purkis et al. |
| 6,607,030 | B2 | 8/2003 | Bauer et al. |
| 6,659,184 | B1 | 12/2003 | Tips et al. |
| 6,672,382 | B2 | 1/2004 | Schultz et al. |
| 6,672,409 | B1 | 1/2004 | Dock et al. |
| 6,717,283 | B2 | 4/2004 | Skinner et al. |
| 6,768,214 | B2 | 7/2004 | Schultz et al. |
| 6,786,285 | B2 | 9/2004 | Johnson et al. |
| 6,874,361 | B1 | 4/2005 | Meltz et al. |
| 6,914,345 | B2 | 7/2005 | Webster |
| 6,920,085 | B2 | 7/2005 | Finke et al. |
| 2002/0096887 | A1 | 7/2002 | Schultz et al. |
| 2005/0051323 | A1 | 3/2005 | Fripp et al. |
| 2005/0230973 | A1 | 10/2005 | Fripp et al. |
| 2005/0230974 | A1 | 10/2005 | Masters et al. |
| 2006/0064972 | A1 | 3/2006 | Allen |

FOREIGN PATENT DOCUMENTS

| | | |
|---|---|---|
| WO | WO 01/39284 | 5/2001 |
| WO | WO 02/10553 | 2/2002 |
| WO | WO 02/057589 | 7/2002 |

OTHER PUBLICATIONS

Jaffe, B., Cook, W. R., Jaffe, H., "Piezoelectric Ceramics", Marietta: R.A.N. Publishers, 1971; Chapters 1, 2 and 12.
Journal of Hydraulic Engineering, "Sediment Management with Submerged Vanes. 1: Theory", vol. 117, dated Mar. 1991.
McGraw-Hill, Inc., "Fluid Mechanics", dated 1979, 1986.
Office Action for U.S. Appl. No. 10/658,899 dated Sep. 14, 2005.
Office Action for U.S. Appl. No. 10/658,899 dated Feb 23, 2006.
Office Action for U.S. Appl. No. 10/825,350 dated Oct. 31, 2005.
Office Action for U.S. Appl. No. 10/825,350 dated Mar. 10, 2006.
Office Action for U.S. Appl. No. 10/826,952 dated Dec. 6, 2005.
Parkinson, Geoffrey, "Phenomena and Modelling of Flow-Induced Vibrations of Bluff Bodies", Progress in Aerospace Sciences, vol. 26, pp. 169-224, 1989.
"Characteristics of Relaxor-Based Piezoelectric Single Crystals for Ultrasonic Transducers," IEEE Transactions on Ultrasonics, Ferroelectrics, and Frequency Control, 44(5):1140-1147 (Sep. 1997).
Hall & Prechtl "Development of a Piezoelectric Servoflap for Helicopter Rotor Control," Smart Materials and Structures vol. 5 1996 pp. 26-34.
PI (Physik Instrumente), "NanoAutomation®, Piezo Technology NanoPositioning MicroPositioning Hexapods", dated 1996-2004.
PI, "Introduction to Piezo Actuators", dated 1996-2004.
"Closed-Loop, High Deflection PICMA® Multilayer Piezo Bender Actuators", undated.
"PICA-Stack Piezoceramic Actuators Versatile Piezoelectric Power", undated.
International Preliminary Report on Patentability and Written Opinion of the International Searching Authority issued for PCT/US2005/003928 dated Aug. 23, 2007 (5 pages).
Office Action dated Aug. 28, 2006 for U.S. Appl. No. 10/826,952.
U.K. Search Report for application No. GB 0419933.7.
International Search Report for PCT/US2005/019087.
Written Opinion for PCT/US2005/019087.
International Search Report for PCT/US2005/029007.
Written Opinion for PCT/US2005/029007.
International Search Report for PCT/US2005/003928.
Written Opinion for PCT/US2005/003928.
International Search Report for PCT/US2005/003911.
Written Opinion for PCT/US2005/003911.
Baker Oil Tools, "Flow Control Systems", undated.
"Extracting Engery From Natural Flow", NASA Tech Briefs, Spring 1980, vol. 5, No. 1, MFS-23989.
Blevins, Robert, "Flow induced vibration", Van Nostrand Reinhold Co., N.Y., 1977; Chapters 3 and 4.
Office Action issued for U.S. Appl. No. 11/346,738 dated Feb. 20, 2008 (32 pages).
International Preliminary Report on Patentability and Written Opinion issued for International Patent Application No. PCT/US2005/029007 dated Feb. 28, 2008 (5 pages).

PULSE WIDTH MODULATED DOWNHOLE FLOW CONTROL

CROSS-REFERENCE TO RELATED APPLICATION

The present application claims the benefit under 35 USC §119 of the filing date of International Application No. PCT/US2005/029007, filed Aug. 15, 2005. The entire disclosure of this prior application is incorporated herein by this reference.

BACKGROUND

The present invention relates generally to equipment utilized and operations performed in conjunction with a subterranean well and, in an embodiment described herein, more particularly provides a pulse width modulated downhole flow control.

Typical downhole flow control devices are designed for permitting substantially continuous flow rates therethrough. For example, a sliding sleeve valve may be set at open and closed positions to permit respective maximum and minimum flow rates through the valve. A downhole choke may be set at a position between fully open and fully closed to permit a substantially continuous flow rate (provided certain parameters, such as fluid density, temperature, etc., do not change) which is between respective maximum and minimum flow rates.

However, it may be beneficial in some circumstances (e.g., to enhance productivity, sweep, etc.) to be able to control or change the flow rate through a downhole flow control device. This cannot conveniently be accomplished using typical flow control devices, because they generally require intervention into the well, application of pressure via long restrictive control lines and/or operation of complex control systems, etc. Therefore, improvements are needed in downhole flow control devices to permit variable control of flow rates through the devices.

An electrically powered flow control device could be suitable for controlling flow rates. The most common methods of supplying electrical power to well tools are use of batteries and electrical lines extending to a remote location, such as the earth's surface.

Unfortunately, some batteries cannot operate for an extended period of time at downhole temperatures, and those that can must still be replaced periodically. Electrical lines extending for long distances can interfere with flow or access if they are positioned within a tubing string, and they can be damaged if they are positioned inside or outside of the tubing string.

Therefore, it may be seen that it would be very beneficial to be able to generate electrical power downhole, e.g., in relatively close proximity to a flow control device which consumes the electrical power. This would preferably eliminate the need for batteries, or at least provide a means of charging the batteries downhole, and would preferably eliminate the need for transmitting electrical power over long distances.

SUMMARY

In carrying out the principles of the present invention, a downhole flow control system is provided which solves at least one problem in the art. An example is described below in which flow through a flow control device is used to vibrate a flow restrictor, thereby displacing magnets relative to one or more electrical coils and generating electricity. The electricity is used to operate an actuator which affects or alters the flow rate through the flow control device.

In one aspect of the invention, a downhole flow control system is provided which includes a flow control device with a flow restrictor which variably restricts flow through the flow control device. An actuator varies a vibratory motion of the restrictor to thereby variably control an average flow rate of fluid through the flow control device.

In another aspect of the invention, a method of controlling flow in a well includes the steps of: installing a flow control device in the well, the flow control device including a flow restrictor which variably restricts flow through the flow control device; and displacing the restrictor to thereby pulse a flow rate of fluid through the flow control device.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
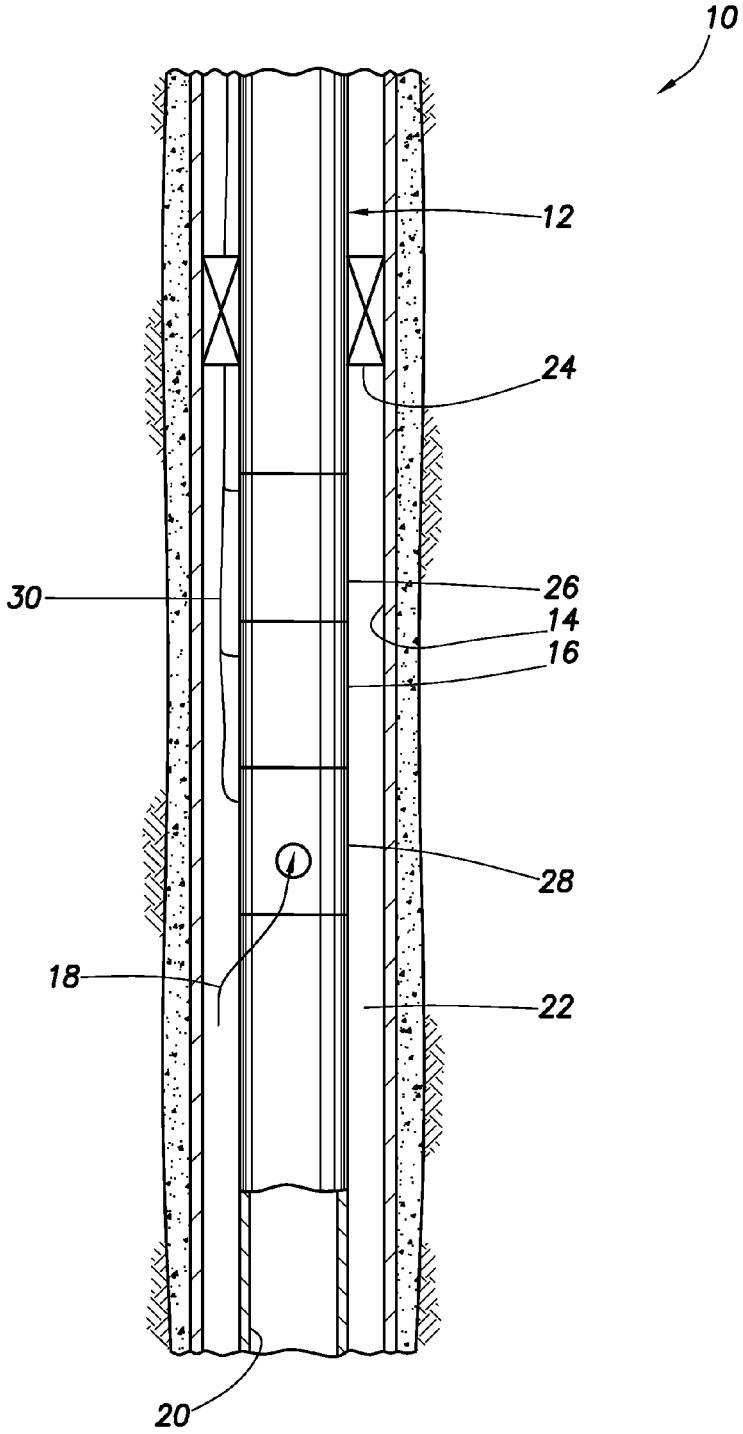
FIG. 1 is a schematic partially cross-sectional view of a downhole flow control system embodying principles of the present invention.

Representatively illustrated in FIG. 1 is a downhole flow control system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 (such as a production, injection, drill, test or coiled tubing string) has been installed in a wellbore 14. A flow control device 28 is interconnected in the tubular string 12. The flow control device 28 generates electrical power from flow of fluid (represented by arrow 18) through the device into an internal flow passage 20 of the tubular string 12.

The fluid 18 is shown in FIG. 1 as flowing upwardly through the tubular string 12 (as if the fluid is being produced), but it should be clearly understood that a particular direction of flow is not necessary in keeping with the principles of the invention. The fluid 18 could flow downwardly (as if being injected) or in any other direction. Furthermore, the fluid 18 could flow through other passages (such as an annulus 22 formed radially between the tubular string 12 and the wellbore 14) to generate electricity, if desired.

The flow control device 28 is illustrated in FIG. 1 as being electrically connected to various well tools 16, 24, 26 via lines 30 external to the tubular string 12. These lines 30 could instead, or in addition, be positioned within the tubular string 12 or in a sidewall of the tubular string. As another alternative, the well tools 16, 24, 26 (or any combination of them) could be integrally formed with the flow control device 28, for example, so that the lines 30 may not be used at all, or the lines could be integral to the construction of the device and well tool(s).

The well tool 24 is depicted in FIG. 1 as being an electrically set packer. For example, electrical power supplied via the lines 30 could be used to initiate burning of a propellant to generate pressure to set the packer, or the electrical power could be used to operate a valve to control application of pressure to a setting mechanism, etc.

The well tools 16, 26 could be any type of well tools, such as sensors, flow control devices, samplers, telemetry devices, etc., or any combination of well tools. The well tool 26 could also be representative of instrumentation for another well tool, such as a control module, actuator, etc. for operating the well tool 16. As another alternative, the well tool 26 could be one or more batteries used to store electrical power for operating the well tool 16.

The flow control device 28 is used in the system 10 to both generate electricity and control flow between the passage 20 and the annulus 22. Alternatively, the device 28 could be a flow control device which controls flow in the passage 20, such as a safety valve. Note that it is not necessary for the flow control device 28 to generate electricity in keeping with the principles of the invention, since electricity could be provided by other means (such as downhole batteries or another electrical source), and power sources other than electrical (such as hydraulic, mechanical, optical, thermal, etc.) could be used instead.

Although certain types of well tools 16, 24, 26 are described above as being operated using electrical power generated by the device 28, it should be clearly understood that the invention is not limited to use with any particular type of well tool. The invention is also not limited to any particular type of well installation or configuration.

Figure 2:
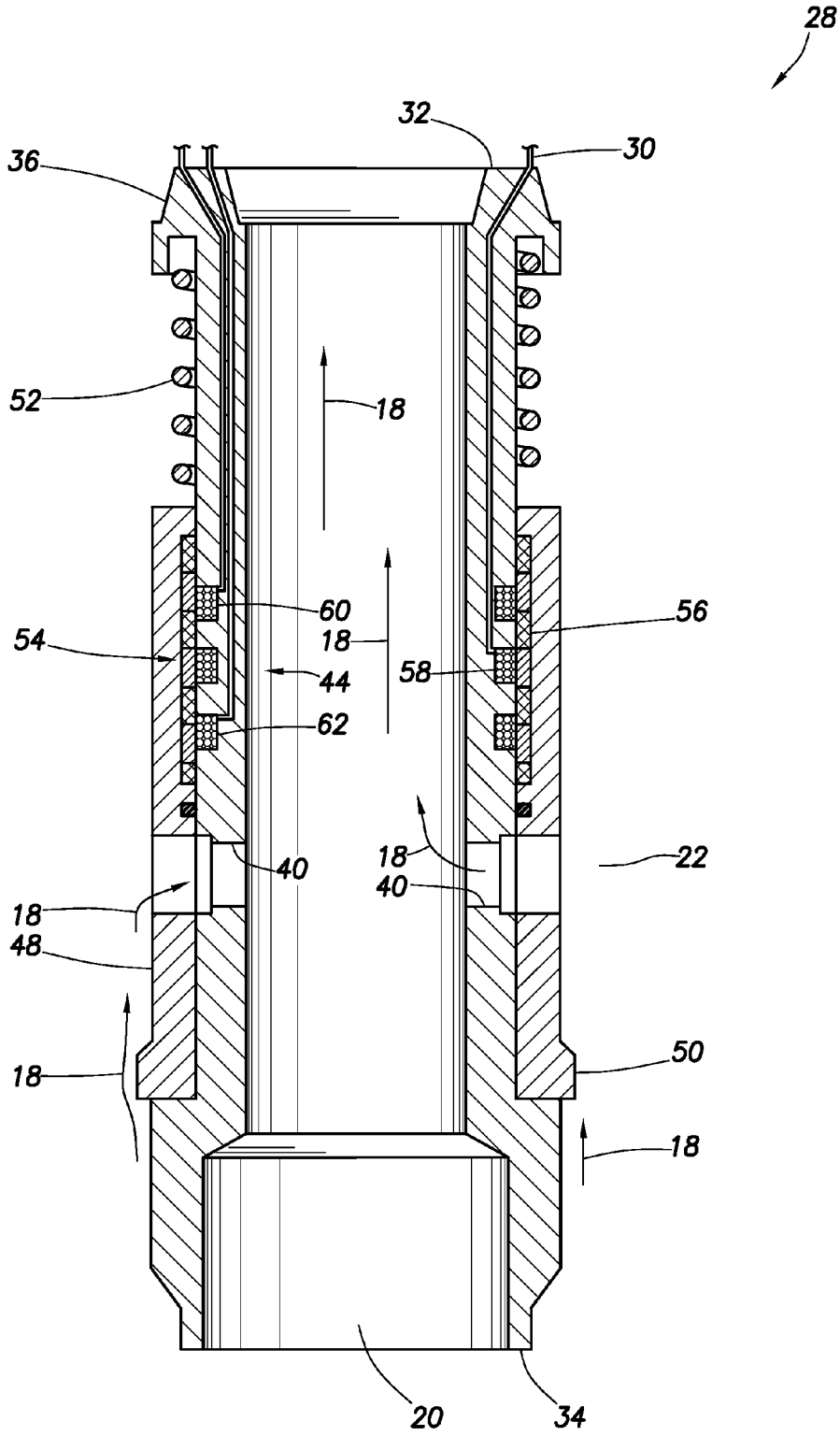
FIG. 2 is an enlarged scale schematic cross-sectional view of a flow control device which may be used in the system of FIG. 1.

Referring additionally now to FIG. 2 an enlarged scale schematic cross-sectional view of the device 28 is representatively illustrated. The device 28 is shown apart from the remainder of the system 10, it being understood that in use the device would preferably be interconnected in the tubular string 12 at upper and lower end connections 32, 34 so that the passage 20 extends through the device.

Accordingly, in the system 10 the fluid 18 flows upwardly through the passage 20 in the device 28. The fluid 18 could flow in another direction (such as downwardly through the passage 20, etc.) if the device 28 is used in another system.

The passage 20 extends through a generally tubular housing 36 of the device 28. The housing 36 may be a single tubular member or it may be an assembly of separate components.

The housing 36 includes openings 40 formed through its sidewall. The fluid 18 flows from the annulus 22 into the passage 20 through the openings 40.

A flow restrictor 48 is reciprocably mounted on the housing 36. The restrictor 48 operates to variably restrict flow through the openings 40, for example, by varying an unobstructed flow area through the openings. The restrictor 48 is illustrated as a sleeve, but other configurations, such as needles, cages, plugs, etc., could be used in keeping with the principles of the invention.

As depicted in FIG. 2, the openings 40 are fully open, permitting relatively unobstructed flow through the openings. If, however, the restrictor 48 is displaced upwardly, the flow area through the openings 40 will be increasingly obstructed, thereby increasingly restricting flow through the openings.

The restrictor 48 has an outwardly extending annular projection 50 formed thereon which restricts flow through the annulus 22. Because of this restriction, a pressure differential is created in the annulus 22 between upstream and downstream sides of the projection 50. As the fluid 18 flows through the annulus 22, the pressure differential across the projection 50 biases the restrictor 48 in an upward direction, that is, in a direction which operates to increasingly restrict flow through the openings 40.

Note that the pressure differential may be caused by other types of flow disturbances. It is not necessary for a restriction in flow of the fluid 18 to be used, or for the projection 50 to be used, in keeping with the principles of the invention.

Upward displacement of the restrictor 48 is resisted by a biasing device 52, such as a coil spring, gas charge, etc. The biasing device 52 applies a downwardly directed biasing force to the restrictor 48, that is, in a direction which operates to decreasingly restrict flow through the openings 40.

If the force applied to the restrictor 48 due to the pressure differential across the projection 50 exceeds the biasing force applied by the biasing device 52, the restrictor 48 will displace upward and increasingly restrict flow through the openings 40. If the biasing force applied by the biasing device 52 to the restrictor 48 exceeds the force due to the pressure differential across the projection 50, the restrictor 48 will displace downward and decreasingly restrict flow through the openings 40.

Note that if flow through the openings 40 is increasingly restricted, then the pressure differential across the projection 50 will decrease and less upward force will be applied to the restrictor 48. If flow through the openings 40 is less restricted, then the pressure differential across the projection 50 will increase and more upward force will be applied to the restrictor 48.

Thus, as the restrictor 48 displaces upward, flow through the openings 40 is further restricted, but less upward force is applied to the restrictor. As the restrictor 48 displaces downward, flow through the openings 40 is less restricted, but more upward force is applied to the restrictor. Preferably, this alternating of increasing and decreasing forces applied to the restrictor 48 causes a vibratory up and down displacement of the restrictor relative to the housing 36.

An average rate of flow of the fluid 18 through the openings 40 may be variably controlled, for example, to compensate for changes in parameters, such as density, temperature, viscosity, gas/liquid ratio in the fluid, etc. (i.e, to maintain a selected relatively constant flow rate, or to change the selected flow rate, etc.). Several methods and systems for variably controlling the average flow rate through a similar flow control device are described in a patent application entitled FLOW REGULATOR FOR USE IN A SUBTERRANEAN WELL, filed Feb. 8, 2005 under the provisions of the Patent Cooperation Treaty, and having application Ser. No. 11/346,738. The entire disclosure of this prior application is incorporated herein by this reference.

Among the methods described in this prior application are varying the biasing forces applied to the restrictor by a biasing device (variably biasing the restrictor to displace in a direction to increase flow) and by a pressure differential (variably biasing the restrictor to displace in a direction to decrease flow). In the present flow control device 28, the biasing forces exerted on the restrictor 48 by the biasing device 52 and the pressure differential across the projection 50 could similarly be controlled to thereby control the average rate of fluid flow through the openings 40.

An electrical generator 54 uses the vibratory displacement of the restrictor 48 to generate electricity. As depicted in FIG. 2, the generator 54 includes a stack of annular shaped permanent magnets 56 carried on the restrictor 48, and a coil 58 carried on the housing 36.

Of course, these positions of the magnets 56 and coil 58 could be reversed, and other types of generators may be used in keeping with the principles of the invention. For example, any of the generators described in U.S. Pat. No. 6,504,258, in U.S. published application no. 2002/0096887, or in U.S. application Ser. Nos. 10/826,952 10/825,350 and 10/658,899 could be used in place of the generator 54. The entire disclosures of the above-mentioned patent and pending applications are incorporated herein by this reference.

It will be readily appreciated by those skilled in the art that as the magnets 56 displace relative to the coil 58 electrical power is generated in the coil. Since the restrictor 48 displaces alternately upward and downward relative to the housing 36, alternating polarities of electrical power are generated in the coil 58 and, thus, the generator 54 produces alternating current. This alternating current may be converted to direct current, if desired, using techniques well known to those skilled in the art.

Note that the generator 54 could be used to produce electrical power even if the fluid 18 were to flow downwardly through the passage 20, for example, by inverting the device 28 in the tubular string 12 and positioning the restrictor 48 in the passage 20, etc. Thus, the invention is not limited to the specific configuration of the device 28 and its generator 54 as described above.

It may be desirable to be able to regulate or variably control the vibration of the restrictor 48. For example, damage to the generator 54 might be prevented, or its longevity may be improved, by limiting the amplitude and/or frequency of the vibratory displacement of the restrictor 48. A desired average flow rate of fluid through the flow control device 28 may be maintained while various parameters of the fluid (such as density, viscosity, temperature, gas/liquid ratio, etc.) vary by variably controlling the vibratory displacement of the restrictor 48. Furthermore, the average rate of flow of the fluid 18 through the openings 40 may be varied (e.g., changed to different levels in a desired pattern, such as alternately increasing and decreasing the average flow rate, repeatedly changing the average flow rate to predetermined levels, etc.) in order to, for example, increase productivity of a reservoir drained by the well, improve sweep in an injection operation, etc.

For these purposes, among others, the device 28 may include an electrical actuator 44 with one or more additional coils 60, 62 which may be energized with electrical power, or shorted to ground, to vary the amplitude, frequency, pulse width and/or dwell of the vibratory displacement of the restrictor 48.

If electrical power is used to energize the coils 60, 62, the electrical power may have been previously produced by the generator 54 and stored in batteries or another storage device (not shown in FIG. 2), such as in the well tool 26 as described above. When energized, magnetic fields produced by the coils 60, 62 can dampen the vibratory displacement of the restrictor 48 or assist in displacing the restrictor in a certain direction and/or impede displacement of the restrictor in a certain direction. When shorted to ground, the coils 60, 62 can dampen the vibratory displacement of the restrictor 48 and/or impede displacement of the restrictor in a certain direction.

While the fluid 18 flows through the openings 40 in a pulsed manner (due to the vibratory motion of the restrictor 48), the coils 60, 62 can be alternately energized and de-energized, energized at different levels or shorted to ground in a predetermined pattern, to thereby impede and/or assist vibratory displacements of the restrictor, thereby causing the average flow rate of the fluid through the openings to be maintained at a selected level, or to be changed to different selected levels. A time duration or width of the pulsed flow may be varied by correspondingly varying the timing of the energization and/or shorting of the coils 60, 62.

It will be readily appreciated that the greater the amount of time during which the coils 60, 62 are energized at a level which permits increased flow through the openings 40, the greater will be the average flow rate of the fluid 18 through the openings. Thus, the flow rate through the flow control device 28 may be controlled by modulating the width or time duration of the pulsed flow. This aspect of the invention is described in further detail below.

Figure 3:
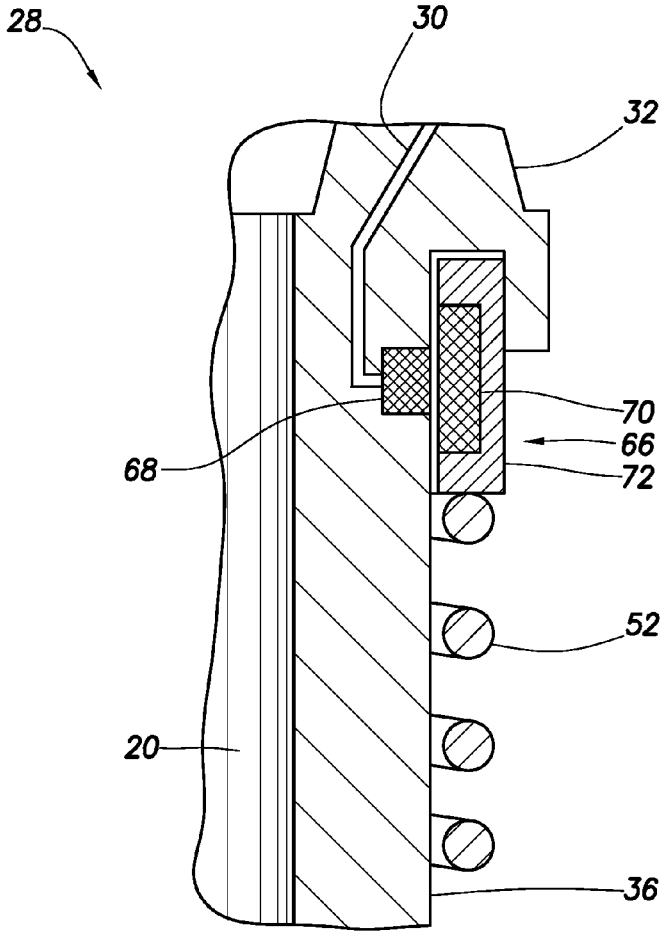
FIG. 3 is an enlarged scale schematic cross-sectional partial view of an alternate construction of the flow control device of FIG. 2.

Referring additionally now to FIG. 3, an alternate construction of the flow control device 28 is representatively illustrated. An enlarged view of only a portion of the flow control device 28 is illustrated in FIG. 3, it being understood that the remainder of the flow control device is preferably constructed as depicted in FIG. 2.

In this alternate construction of the flow control device 28, another actuator 66 is used to vary the biasing force applied to the restrictor 48 by the biasing device 52. The actuator 66 includes a coil 68 and a magnet 70 positioned within a sleeve 72 reciprocably mounted on the housing 36 above the biasing device 52. Of course, different numbers of coils and magnets, and different positioning of these elements may be used, in keeping with the principles of the invention.

As will be appreciated by those skilled in the art, the actuator 66 may be used to increase the biasing force applied to the restrictor 48 (i.e., by increasing a downwardly biasing force applied to the sleeve 72 by magnetic interaction between the coil 68 and magnet 70), and to decrease the biasing force applied to the restrictor (i.e., by decreasing the downwardly biasing force applied to the sleeve by the magnetic interaction between the coil and magnet). Furthermore, as discussed above, such increased biasing force will operate to increase the average flow rate of the fluid 18 through the flow control device 28, and such decreased biasing force will operate to decrease the average flow rate of the fluid through the flow control device.

Electricity to energize the coil 68 may be generated by the vibratory displacement of the restrictor 48 as described above. Alternatively, the coil 68 may be energized by electricity generated and/or stored elsewhere.

Figure 4:
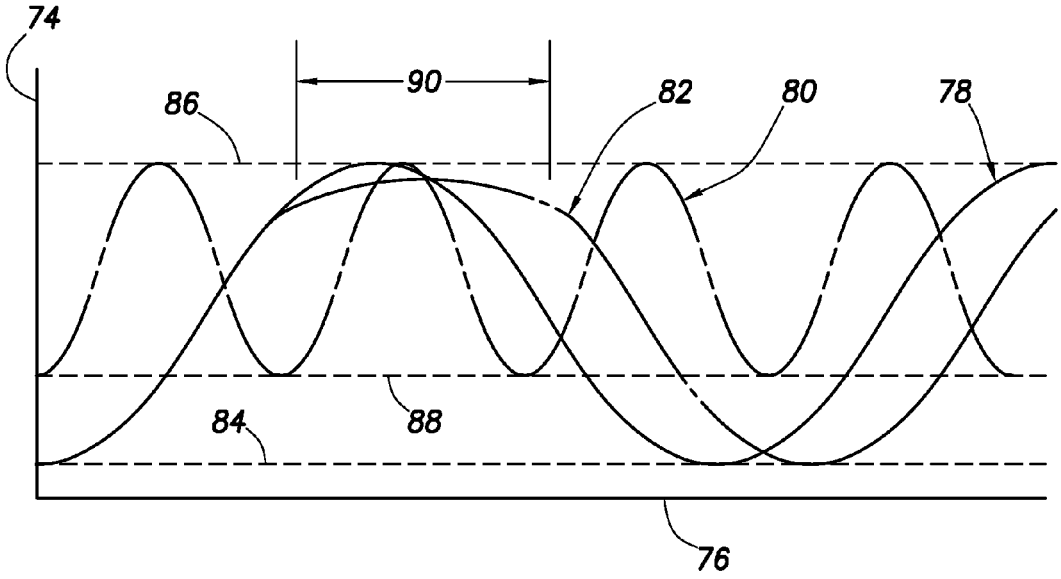
FIG. 4 is a graph of flow rate through the flow control device versus time, the vertical axis representing flow rate, and the horizontal axis representing time.

Referring additionally now to FIG. 4, a graph of instantaneous flow rate through the flow control device 28 versus time is representatively illustrated. A vertical axis 74 on the graph represents flow rate through the flow control device 28, and a horizontal axis 76 on the graph represents time.

Three different curves 78, 80, 82 are drawn on the graph. The curve 78 represents a reference pulsed flow rate of the fluid 18 through the flow control device 28. Note that the flow rate indicated by curve 78 varies approximately sinusoidally between a minimum amplitude 84 and a maximum amplitude 86.

The curve 78 shows that the flow rate through the flow control device 28 pulses (i.e., alternately increases and decreases) due to the vibratory displacement of the restrictor 48. As the restrictor 48 displaces upward, the flow rate decreases, and as the restrictor displaces downward, the flow rate increases.

An average of the flow rate as indicated by the curve 78 may be mathematically determined, and the average will be between the minimum and maximum amplitudes 84, 86. Note that the curve 78 may not be perfectly sinusoidal due, for example, to friction effects, etc.

The curve 80 represents one way in which the flow rate through the flow control device 28 can be changed using the principles of the invention. Note that the pulsed flow rate as indicated by curve 80 has the same maximum amplitude 86, an increased minimum amplitude 88, an increased frequency (pulses per unit time) and a decreased pulse width (wavelength). It will also be appreciated by those skilled in the art that the average flow rate indicated by the curve 80 is greater than the average flow rate indicated by the curve 78.

Various methods, or a combination of methods, may be used to produce this change from the curve 78 to the curve 80. For example, the actuator 66 described above may be used to increase the biasing force applied to the restrictor 48 via the biasing device 52. Other methods of increasing the biasing force applied to the restrictor 48 may be used as well, such as those described in the above-referenced patent applications.

Another method of producing the change in amplitude, frequency, pulse width and average flow rate from the curve 78 to the curve 80 is to use the actuator 44 to impede and/or assist displacement of the restrictor 48. For example, one or both of the coils 60, 62 could be energized to thereby increase the downward biasing force applied to the restrictor 48, and/or one or both of the coils could be shorted as the restrictor displaces upward to thereby impede upward displacement of the restrictor.

In a similar manner, the average flow rate could be decreased, the maximum amplitude could be decreased, the pulse width could be increased and the frequency could be decreased by reducing the net downward biasing force applied to the restrictor 48. For example, the actuator 66 could be used to decrease the biasing force applied to the restrictor 48 via the biasing device 52, one or both of the coils 60, 62 could be energized to thereby decrease the net downward biasing force applied to the restrictor and/or one or both of the coils could be shorted as the restrictor displaces downward to thereby impede downward displacement of the restrictor.

The curve 82 in FIG. 4 shows that a dwell 90 may be used to change the average flow rate through the flow control device 28. By producing the dwell 90 at the maximum flow rate portion of the curve 82, the pulse width is increased, the frequency is reduced and the average flow rate is increased relative to the curve 78. The maximum amplitude of the curve 82 could be increased or decreased relative to the curve 78 as desired.

The dwell 90 may be produced by any of a variety of methods. For example, the downward biasing force applied to the restrictor 48 via the biasing device 52 could be increased using the actuator 66 when the restrictor approaches its farthest downward position, and then the downward biasing force could be decreased as the restrictor begins to displace upward. Alternatively, or in addition, one or both of the coils 60, 62 could be shorted when the restrictor 48 reaches or approaches its farthest downward position to thereby impede further displacement of the restrictor, and then shorting of the coils could be ceased as the restrictor begins to displace upward. As another alternative, one or both of the coils 60, 62 could be energized when the restrictor 48 approaches its farthest downward position to thereby increase the net downward biasing force applied to the restrictor, and then the coils could be deenergized as the restrictor begins to displace upward.

As depicted in FIG. 4, the maximum amplitude of the curve 82 at the dwell 90 is less than the maximum amplitude 86 of the curve 78, but it will be readily appreciated by those skilled in the art that the maximum amplitude of the curve 82 could be greater than or equal to the maximum amplitude of the curve 78. For example, the timing and extent to which increased downward biasing force or impedance of displacement is applied to the restrictor 48 can be used to determine whether the maximum amplitude of the curve 82 is less than, greater than or equal to the maximum amplitude of the curve 78.

In a similar manner, a dwell could be produced at the minimum amplitude of the curve 82. A dwell at the minimum amplitude of the curve 82 would result in a decreased frequency, decreased average flow rate and an increased pulse width. Such a dwell at the minimum amplitude of the curve 82 could be produced by decreasing the net downward biasing force applied to the restrictor 48 as it approaches its farthest upward position, and/or by impeding displacement of the restrictor at its farthest upward position.

Changes in flow rate amplitude, frequency, pulse width, dwell and average flow rate may also be produced by varying the upward biasing force applied to the restrictor 48 due to the pressure differential created by the projection 50. As described in the above-referenced patent application, the pressure differential can be varied by varying the flow restriction presented by the projection 50.

By increasing the restriction to flow, the upward biasing force applied to the restrictor 48 may be increased, thereby decreasing the average flow rate, decreasing the flow rate amplitude, decreasing the frequency and increasing the pulse width. By decreasing the restriction to flow, the upward biasing force applied to the restrictor 48 may be reduced, thereby increasing the average flow rate, increasing the flow rate amplitude, increasing the frequency and decreasing the pulse width.

The restriction to flow may be increased when the restrictor 48 is at its farthest upward position to produce a dwell at the minimum amplitude of the flow rate curve to thereby decrease the average flow rate, decrease the frequency and increase the pulse width. The restriction to flow may be decreased when the restrictor 48 is at its farthest downward position to produce a dwell at the maximum amplitude of the flow rate curve to thereby increase the average flow rate, decrease the frequency and increase the pulse width.

Thus, it may now be readily appreciated that a desired flow rate frequency, pulse width, dwell and average flow rate may be produced using the flow control device 28 and the methods described above. Each of these parameters may also be varied as desired. The above methods may also be used to vary one or more of the parameters while another one or more of the parameters remains substantially unchanged.

Any of the parameters, or any combination of the parameters, may be detected at a remote location (such as at the surface or another location in the well) as an indication of the flow through the flow control device 28. For example, a change in the pulse width may be detected by a downhole or surface sensor and used as an indication of a change in the average flow rate through the flow control device 28.

Figure 5:
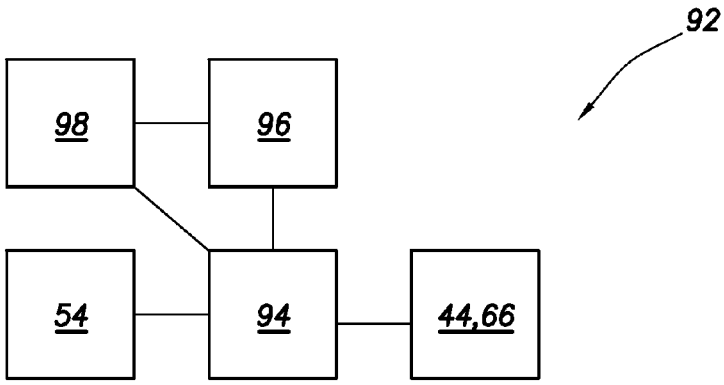
FIG. 5 is a schematic representation of a control system for maintaining and changing a selected average flow rate through the flow control device.

A control system 92 for use in maintaining and controlling the parameters of flow through the flow control device 28 is depicted schematically in FIG. 5. Electrical power for a downhole control system 94 may be provided by the generator 54 and/or by any other power source (such as downhole batteries, electrical lines, etc.). The downhole control system 94 is connected to the actuators 44, 66 and/or any other actuators or devices which may be used to maintain or change any of the parameters of flow through the flow control device 28.

A surface control system 96 may be used to communicate with the downhole control system 94. For example, if a decision is made to change the average flow rate through the flow control device 28, a control signal may be sent from the surface control system 96 to the downhole control system 94, so that the downhole control system will cause a change in frequency, pulse width, amplitude, dwell, etc. to produce the desired average flow rate change. Communication between the downhole and surface control systems 94, 96 may be by any means, such as electrical line, optical line and/or acoustic, pressure pulse or electromagnetic telemetry, etc.

Preferably, the downhole control system 94 normally operates in a closed loop mode whereby the downhole control system maintains one or more of the parameters of the flow through the flow control device 28 at a selected level. The downhole control system 94 may include one or more sensors for use in detecting one or more of the parameters and/or determining whether there exists a variance relative to the selected level. For example, the downhole control system 94 could include a sensor which detects the flow rate pulse width as an indication of the average flow rate through the flow control device. If there is a variance relative to the selected level of the average flow rate, then the downhole control system 94 may utilize the actuators 44, 66 to adjust the flow rate pulse width as needed to produce the selected level of the average flow rate.

Indications from the downhole sensors may be communicated to the surface control system 96. For example, a sensor may detect a frequency or pulse width of the flow rate through the flow control device 28. The sensor output may be transmitted from the downhole control system 94 to the surface control system 96 as an indication of the average flow rate of fluid through the flow control device 28.

Alternatively, or in addition, output from one or more surface sensors may be communicated to the downhole control system 94. For example, a flow rate sensor may be located at the surface to detect the average flow rate of fluid from (or into) the well. The sensor output could be communicated to the downhole control system 94, so that the downhole control system can adjust one or more of the flow parameters as needed to produce the selected level of, or change in, the average flow rate.

As another example, one or more downhole or surface sensors 98 may be used to detect parameters such as density, viscosity, temperature and gas/liquid ratio of the fluid 18. The output of these sensors 98 may be communicated to one or both of the downhole and surface control systems 94, 96. The downhole control system 94 can maintain the selected average flow rate through the flow control device 28 (e.g., by making appropriate adjustments to the flow rate frequency, pulse width, amplitude, dwell, etc., as described above) while one or more of density, viscosity, temperature and gas/liquid ratio of the fluid 18 changes. Note that the sensors 98 could also, or alternatively, detect one or more of the flow parameters (e.g., flow rate frequency, pulse width, amplitude, dwell, average flow rate, etc.) as described above.

Although the flow control device 28 has been described above as being used to control flow between the annulus 22 and the passage 20 by means of relative displacement between the tubular shaped restrictor 48 and housing 36, it should be clearly understood that any other type of flow control device can be used to control flow between any other regions of a well installation by means of elements having any types of shapes, in keeping with the principles of the invention. For example, a restrictor could be needle or nozzle shaped, etc.

Of course, a person skilled in the art would, upon a careful consideration of the above description of representative embodiments of the invention, readily appreciate that many other modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A downhole flow control system, comprising:

a flow control device including a flow restrictor which variably restricts flow through the flow control device, and an actuator which varies a vibratory motion of the restrictor to thereby variably control an average flow rate of fluid through the flow control device.

2. The system of claim 1, wherein the actuator is electrically operated.

3. The system of claim 2, wherein electricity to operate the actuator is generated in response to flow of fluid through the flow control device.

4. The system of claim 2, wherein the restrictor vibrates in response to flow of fluid through the flow control device, thereby generating electricity.

5. The system of claim 1, wherein a flow rate pulse width is modulated to thereby control the average flow rate of fluid through the flow control device.

6. The system of claim 1, wherein a flow rate dwell is modulated to thereby control the average flow rate of fluid through the flow control device.

7. The system of claim 1, wherein a flow rate amplitude is modulated to thereby control the average flow rate of fluid through the flow control device.

8. The system of claim 1, wherein a flow rate frequency is modulated to thereby control the average flow rate of fluid through the flow control device.

9. The system of claim 1, wherein the actuator alternately assists and impedes vibratory displacement of the restrictor to thereby variably control the flow rate of fluid through the flow control device.

10. The system of claim 1, further comprising a downhole control system which controls the actuator, so that the actuator maintains a selected average flow rate of fluid through the flow control device.

11. The system of claim 10, wherein the downhole control system maintains the selected average flow rate while at least one of density, viscosity, temperature and gas/liquid ratio of the fluid changes.

12. The system of claim 10, further comprising a surface control system which communicates with the downhole control system to select the selected average flow rate and to change the selected average flow rate.

13. The system of claim 1, wherein the actuator includes at least one coil which when energized applies a force to the restrictor.

14. The system of claim 1, wherein the actuator includes at least one coil which when shorted impedes displacement of the restrictor.

15. The system of claim 1, wherein the restrictor includes a projection which creates a pressure differential upstream of an opening, thereby biasing the restrictor to displace in a direction to increasingly restrict flow through the opening.

16. The system of claim 1, wherein flow through the flow control device creates a pressure differential upstream of an opening, thereby biasing the restrictor to displace in a direction to increasingly restrict flow through the opening, and further comprising a biasing device which biases the restrictor in a direction to decreasingly restrict flow through the opening.

17. The system of claim 16, wherein a biasing force applied to the restrictor by the biasing device is adjustable downhole.

18. A method of controlling flow in a well, the method comprising the steps of:

installing a flow control device in the well, the flow control device including a flow restrictor which variably restricts flow through the flow control device; and displacing the restrictor to thereby pulse a flow rate of fluid through the flow control device, the displacing step comprising operating an actuator to variably control vibratory displacement of the restrictor.

19. The method of claim 18, further comprising the steps of generating electricity in response to flow of fluid through the flow control device, and utilizing the electricity to operate the actuator in the operating step.

20. The method of claim 18, wherein the displacing step further comprises modulating a flow rate pulse width to thereby control an average of the flow rate of fluid through the flow control device.

21. The method of claim 18, wherein the displacing step further comprises modulating a flow rate dwell to thereby control an average of the flow rate of fluid through the flow control device.

22. The method of claim 18, wherein the displacing step further comprises modulating a flow rate amplitude to thereby control an average of the flow rate of fluid through the flow control device.

23. The method of claim 18, wherein the displacing step further comprises modulating a flow rate frequency to thereby control an average of the flow rate of fluid through the flow control device.

24. The method of claim 18, wherein the displacing step further comprises alternately assisting and impeding vibratory displacement of the restrictor to thereby variably control the flow rate of fluid through the flow control device.

25. The method of claim 18, wherein the displacing step further comprises energizing at least one coil to thereby apply a force to the restrictor.

26. The method of claim 18, wherein the displacing step further comprises shorting at least one coil to thereby impede displacement of the restrictor.

27. The method of claim 18, further comprising the step of creating a pressure differential upstream of an opening, thereby biasing the restrictor to displace in a direction to increasingly restrict flow through the opening.

28. The method of claim 27, further comprising the step of utilizing a biasing device to bias the restrictor in a direction to decreasingly restrict flow through the opening.

29. The method of claim 18, further comprising the step of controlling operation of the actuator using a downhole control system, so that the actuator maintains a selected average flow rate of fluid through the flow control device.

30. The method of claim 29, wherein the controlling step further comprises maintaining the selected average flow rate while at least one of density, viscosity, temperature and gas/liquid ratio of the fluid changes.

31. The method of claim 29, further comprising the step of communicating with the downhole control system via a surface control system to select the selected average flow rate and to change the selected average flow rate.

32. A method of controlling flow in a well, the method comprising the steps of:

installing a flow control device in the well, the flow control device including a flow restrictor which variably restricts flow through the flow control device;

displacing the restrictor to thereby pulse a flow rate of fluid through the flow control device; and vibrating the restrictor in response to flow of fluid through the flow control device, thereby generating electricity.

33. A method of controlling flow in a well, the method comprising the steps of:

installing a flow control device in the well, the flow control device including a flow restrictor which variably restricts flow through the flow control device; and displacing the restrictor to thereby pulse a flow rate of fluid through the flow control device;

creating a pressure differential upstream of an opening, thereby biasing the restrictor to displace in a direction to increasingly restrict flow through the opening;

utilizing a biasing device to bias the restrictor in a direction to decreasingly restrict flow through the opening; and adjusting downhole a biasing force applied to the restrictor by the biasing device.

* * * * *